US005483774A

United States Patent [19]

Siemerink et al.

[11] Patent Number: 5,483,774

[45] Date of Patent: Jan. 16, 1996

[54] CONSTRUCTION ACCORDING TO A DOUBLE-CURVED SURFACE

[76] Inventors: Bernadinus F. A. Siemerink, Buitenvest 2,, NL-4931 CH Geertruidenberg; Wilhelmus J. J. Huisman, Stationsweg 1, NL-5674 TS Nuenen, both of Netherlands

[21] Appl. No.: 190,055

[22] PCT Filed: Jul. 24, 1992

[86] PCT No.: PCT/NL92/00135

§ 371 Date: Mar. 30, 1994

§ 102(e) Date: Mar. 30, 1994

[87] PCT Pub. No.: WO93/03233

PCT Pub. Date: Feb. 18, 1993

[30] Foreign Application Priority Data

Jul. 30, 1991 [NL] Netherlands ..... 9101309

[51] Int. Cl.[6] ..... E04B 1/32

[52] U.S. Cl. ..... 52/81.2; 52/81.1; 52/80.1; 52/80.2; 52/82; 52/222

[58] Field of Search ..... 52/80.1, 80.2, 52/81.1, 81.2, 82, 222, 461, 467

[56] References Cited

U.S. PATENT DOCUMENTS

| | | | |
|---|---|---|---|
| 459,980 | 9/1891 | Taylor | 52/467 |
| 2,167,048 | 7/1939 | Legarda | 52/81.2 |
| 2,908,236 | 10/1959 | Kiewitt | 52/81.2 |
| 3,204,372 | 9/1965 | Richter . | |
| 3,225,504 | 12/1965 | Gregoire | 52/222 |
| 3,280,518 | 10/1966 | White, Jr. | 52/80.2 |
| 3,295,267 | 1/1967 | Lundell | 52/222 |
| 3,757,478 | 9/1973 | Pryor | 52/80.2 |
| 4,009,543 | 3/1977 | Smrt . | |
| 4,776,139 | 10/1988 | Lockwood | 52/82 |

FOREIGN PATENT DOCUMENTS

| | | |
|---|---|---|
| 2144616 | 2/1973 | France . |
| 2274751 | 1/1976 | France . |
| 153006 | 7/1904 | Germany . |
| 2029785 | 12/1970 | Germany . |
| 7006912 | 11/1971 | Netherlands . |

OTHER PUBLICATIONS

J. B. Thring, "Folded Plywood Plate", Wood, vol. 32, No. 2, Feb. 1967, Benn Brothers Ltd. London, (GB).

*Primary Examiner*—Carl D. Friedman
*Assistant Examiner*—Christopher Todd Kent
*Attorney, Agent, or Firm*—Banner & Allegretti, Ltd.

[57] ABSTRACT

A construction formed along a single or double-curved surface which is provided with supporting elements extending substantially parallel, the supporting sides of which are situated within the double-curved surface, and strips of substantially planar, slightly flexible material, the width of which is at least equal to the distance between the elements, which strips extend between adjacent elements. In known constructions it is not possible to cover such double-curved surfaces with one type of similar element. A large number of different elements is required for a continuous covering. The present invention avoids this drawback because only the above stated two types of elements are required.

14 Claims, 3 Drawing Sheets

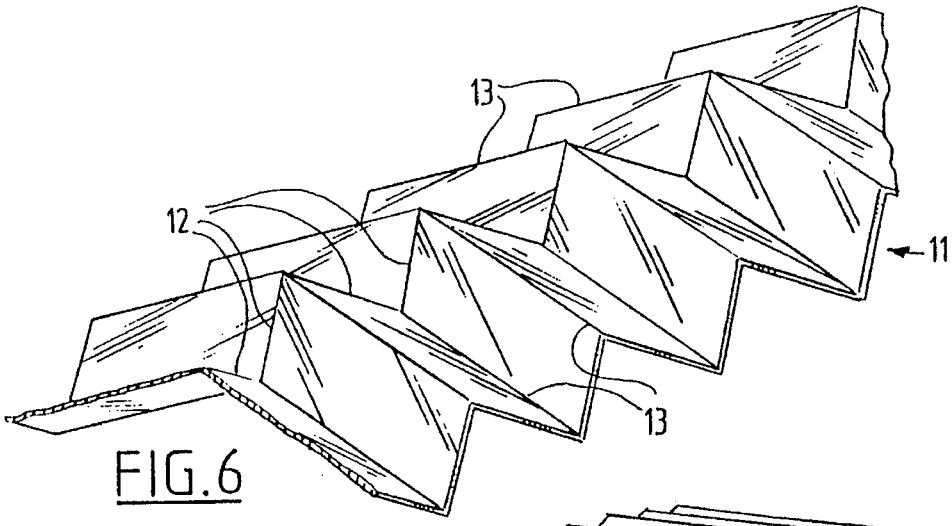
FIG.6
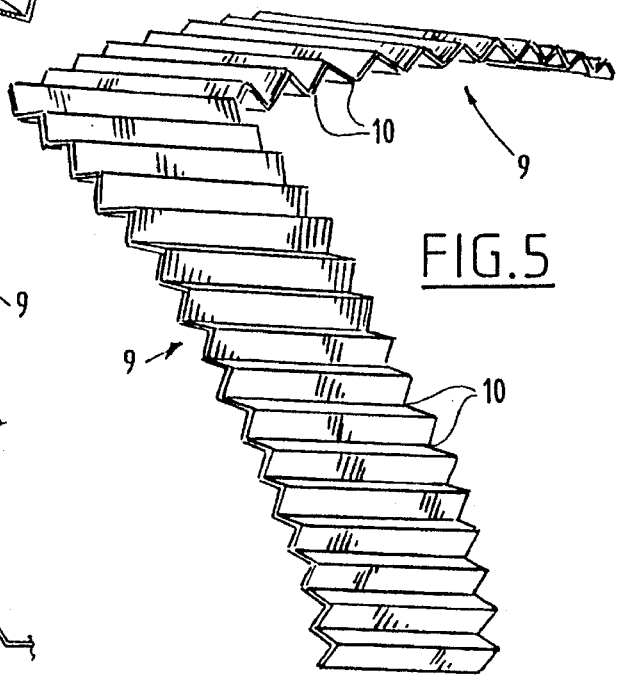
FIG.5
FIG.7
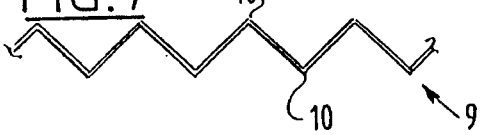
FIG.8
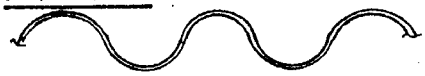
FIG.9
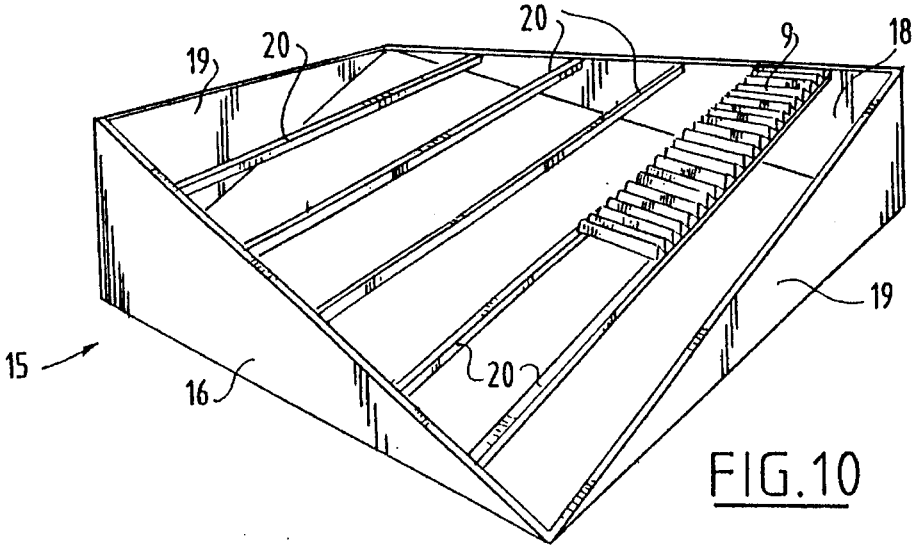
FIG.10

CONSTRUCTION ACCORDING TO A DOUBLE-CURVED SURFACE

BACKGROUND AND SUMMARY OF THE INVENTION

The present invention relates to a construction along a double curved surface. Such constructions are generally known, for instance as a spherical skin-shaped construction or as a construction with the form of a hyperbolic paraboloid.

With known techniques it is not possible to continuously clad double curved surfaces with the same plates. Use is then usually made of plate-like elements partially overlapping each other. These elements result in material loss, they require much labour in fitting and lead to sealing problems in respect of water drainage.

A preferred embodiment of the present invention undertakes to avoid these drawbacks. This secondary objective is achieved by a supporting construction which is formed by:

supporting elements extending substantially parallel, the supporting sides of which are situated within the double curved surface; and strips of substantially planar, slightly flexible material, the width of which is at least equal to the distance between elements, which strips extend between adjacent elements.

The above stated drawbacks are avoided as a result of these steps.

The present invention relates particularly to a spherical skin-shaped construction.

Such constructions are generally known. Common use is herein made of for instance triangular or hexagonal elements which are either self-supporting and joined together to form an entity or are placed in a pre-constructed frame so that a closed spherical skin-shaped structure is obtained.

The problem in these known constructions is that it is not possible to clad a spherical skin-shaped structure with one type of element, for instance a triangular element. A planar surface will in any case result from joining together triangles. Six triangles herein converge at one angular point.

When five triangles converge at one angular point this results in a regular icosahedron. Four triangles converging in an angular point result in a regular octahedron; and three triangles converging in a triangular point result in a regular tetrahedron.

Also when cladding takes place with regular hexagons a planar surface will result.

It is thus not possible to cover an approximately spherical skin-shaped surface with regularly formed geometric elements. In order to cover a spherical surface it is therefore necessary to have available a number of elements whereof the dimensions are unequal. Experience has taught that a large number of different elements must be used to build such a spherical skin-shaped structure. This naturally has the effect of increasing the cost of such a structure.

This applies both in the case of a self-supporting construction and a construction wherein cladding elements are fixed to a frame.

A secondary objective of the present invention is to provide a substantially spherical skin-shaped construction which can be built at a comparatively low price.

This object is achieved by a substantially spherical skin-shaped construction as according to claim 1 comprising:

a number of regularly distributed primary main elements extending radially along the construction from the centre to the edge;

a number of secondary main elements corresponding with the number of primary main elements and extending radially intermediate the main elements;

primary sub-elements extending parallel to the closest primary main element from the secondary main elements to the edge such that the distance between the primary main element and the closest primary dub-element and the mutual distances between the primary sub-elements are substantially equal;

strips of substantially flat, slightly flexible material which extend to the edge from each secondary main element between a pair of primary sub-elements, respectively between a primary sub-element and a primary main element, wherein the strips are supported by the primary sub-elements, respectively by a primary sub-element and a primary main element and the width of which is at least equal to the mutual distance between the primary sub-elements.

As a result of these steps only primary main elements, secondary main elements and primary sub-elements need be kept in stock in addition to rolls of cladding material.

As a consequence hereof the total number of different components required for the construction is considerably limited, while the primary main and sub-elements can correspond with one another. Further, the strips of cladding material are simply material supplied to length which can be shortened so that it can be delivered on rolls. Use of folded or corrugated plate results in a still greater cost limitation.

The secondary sub-elements used in accordance with a preferred embodiment also have only a small cost-increasing effect; however, they make a considerable contribution towards the construction strength.

According to an embodiment the elements are formed by rods mutually connected in joints. The elements could be formed by girders or walls. It is also possible to apply a grid construction in the form of a continuous skin.

The present invention thus provides a spherical skin-shaped construction the building costs of which are considerably reduced compared to the currently known art for building such structures.

BRIEF DESCRIPTION OF THE DRAWINGS

The present invention will subsequently be elucidated with reference to the annexed drawings, in which:

FIG. 5 is a schematic perspective view of two covering strips according to the present invention;

FIG. 6 is a schematic perspective view of a sealing strip according to the present invention;

FIG. 7 shows a sectional view of an alternative embodiment of a covering strip;

FIG. 8 shows a sectional view of yet another embodiment of a covering strip;

FIG. 9 shows a sectional view of a third embodiment of the covering strip; and FIG. 10 is a schematic perspective view of a double curved surface embodied according to the invention.

DETAILED DESCRIPTION OF THE PREFERRED EMBODIMENTS

Figure 1:
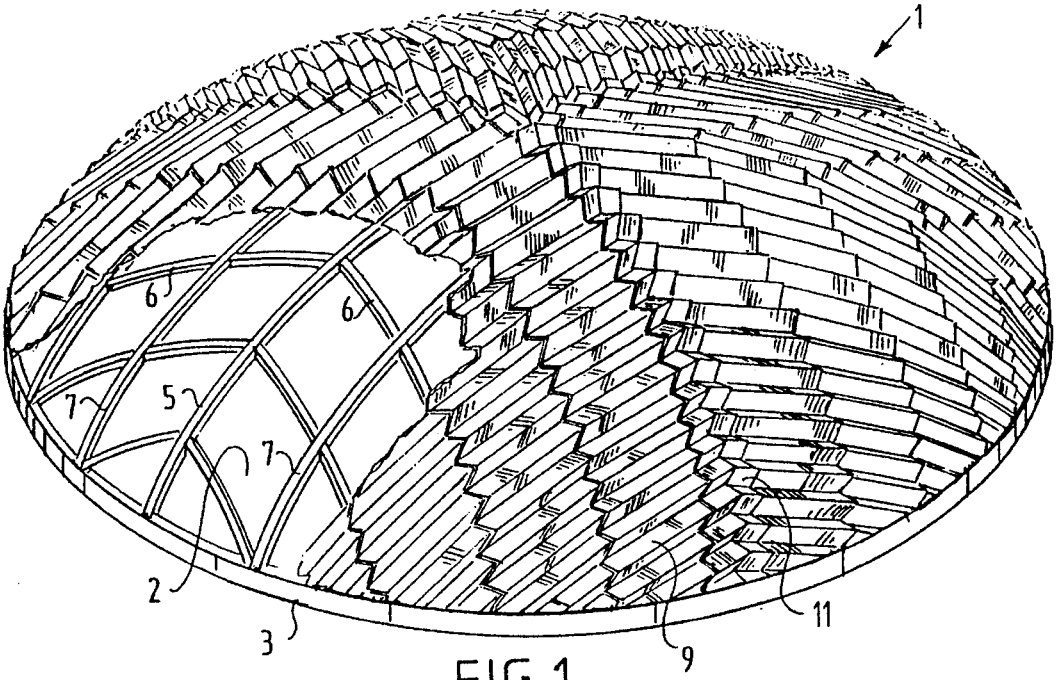
FIG. 1 shows a partly broken away perspective view of a construction according to the present invention, wherein the construction is divided into six segments.
Figure 2:
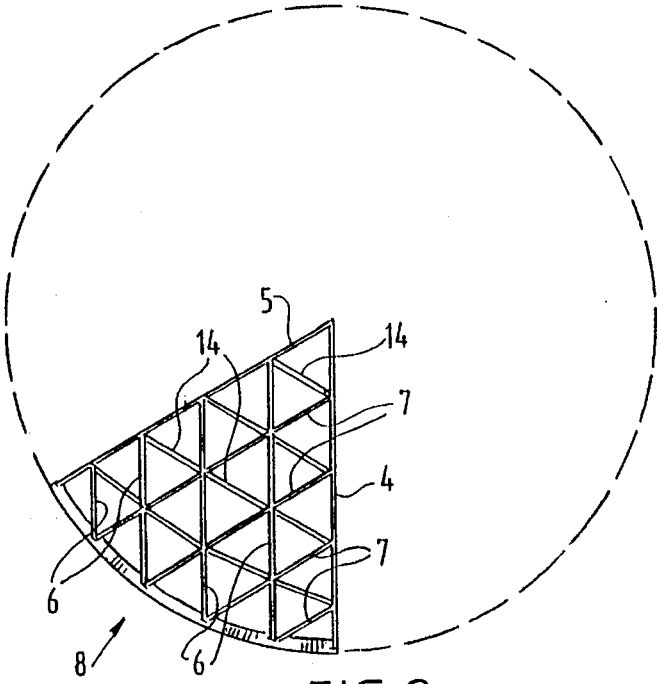
FIG. 2 is a schematic top view of the construction according to the present invention, wherein the placing of a primary main girder, a primary sub-girder and a series of secondary main and sub-girders arranged therebetween and of tertiary girders arranged between joints is shown.

The following description relates to the embodiment shown in FIGS. 1 and 2 of the spherical skin-shaped construction 1, wherein the spherical skin is divided into six equal segments.

Primary main girders 4 and secondary main girders 5 are initially erected on a bottom surface 2 which is encircled by an edge 3 and the girders are mutually connected in the centre of the construction 1. Although in principle there is no difference either in the shape or function of the primary main girders 4 and secondary main girders 5, this distinction is made to facilitate use of language in the claims. It is however possible for the dimensioning of both types of main girder 4, 5 to differ.

The primary sub-girders 6 are subsequently arranged, this such that in each sector 8 bounded by a primary main girder 4 and a secondary main girder 5 they extend from the secondary main girder 5 substantially parallel to the primary main girder 4.

The mutual distances between the primary sub-girders 6 are equal to the distance between primary main girder 4 and the closest primary sub-girder 6.

Finally, secondary sub-girders 7 are arranged which extend parallel to the closest secondary main girder 5. The primary sub-girders 6 are herein intersected. From considerations of dimensioning the distance between the secondary sub-girders is equal. These primary sub-girders are not however essential for the present invention. They may be omitted when the construction has sufficiently small dimensions.

Shown in FIG. 2 is an embodiment of the invention wherein tertiary girders 14 are arranged between the joints of primary and secondary girders. These tertiary girders 14 extend substantially in tangential direction relative to the centre. These tertiary girders thus form polygons centered round the centre. Dimensioning requirements for the primary and secondary girders are hereby lessened. Such a construction is known as a dome. Rod-like elements are herein often used as girders.

The actual cladding of the construction is subsequently arranged in the form of zigzag folded strips 9. The width of these zigzag folded strips 9 is slightly greater than the distance between two primary sub-girders, respectively the distance between a primary main girder and the closest primary sub-girder. The strips 9 are then arranged in each sector 8 on top of two primary main girders, this such each strip extends as far as the edge from the relevant primary sub-girders over two primary main girders, respectively over a primary main girder and a primary sub-girder.

It is herein prudent to begin from the bottom so the zigzag strips rest on each other in the manner of roof tiles and a good water drainage is obtained.

It is also noted that due to the zigzag form the strips 9 have a certain degree of elasticity; they are elastic such that they can adapt in one direction to the curvature in directions of the spherical skin. It is also possible to make use of roof cladding material which, without folds, also already has the required degree of elasticity. Particular plastics could for instance be so employed.

This elasticity is also of importance for joining together the zigzag waves of diverse strips 8 so that they as it were "fit" together on the boundary of two adjacent strips. A good water drainage is hereby obtained. The direction of the folds of strip 9 is also important; this direction is such that the strips meeting at the secondary main girder are mutually parallel.

In addition to making contact at the location of the secondary main girders the strips of adjacent sectors 8 also make contact at the position of the primary main girders 4. In general the folds 10 in the strips 9 will then not be mutually parallel so that they cannot mutually overlap. For this purpose separate sealing strips 11 are arranged which are folded in accordance with a herringbone pattern such that they "fittingly" overlap the relevant strips 9. A watertight closure of mutually connecting strips 9 is thus obtained at the location of the primary main girder 4 so that the entire spherical skin-shaped structure can be made watertight.

In summary, a good sealing is obtained within the relevant sector 8 by mutually connecting the relevant strips 9, while at boundaries between sectors at the location of secondary main girders the strips connect mutually in the manner of roof tiles and at the position of the primary main girders additional sealing strips 11 are arranged.

Figure 3:
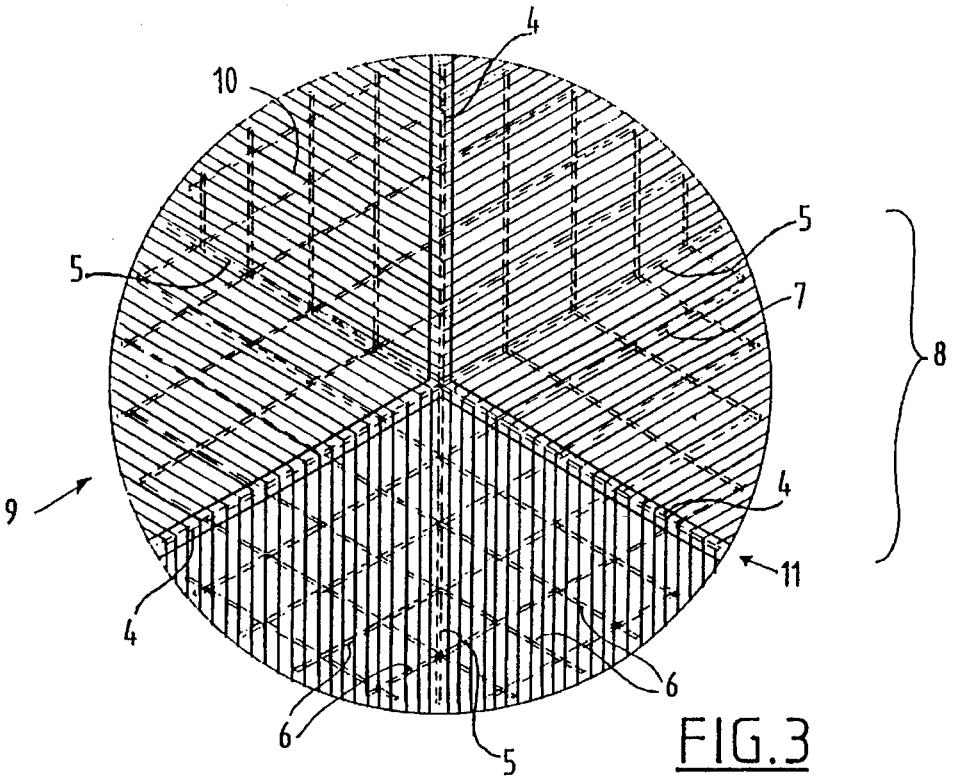
FIG. 3 is a schematic top view of a roof construction according to the present invention, wherein the placing of the girders and the direction of the folds arranged in the covering strips are shown and wherein the construction is divided into six sectors.

FIG. 3 shows the thus obtained construction in top elevation. It can be seen here how in top view the structure of a snow crystal is obtained with the division into six segments. Shown in dashed lines are the primary main girders 4, the secondary main girders 5, the primary sub-girders 6 and the secondary sub-girders 7. The fold lines 10 of the strips 9 are further shown in full lines.

Figure 4:
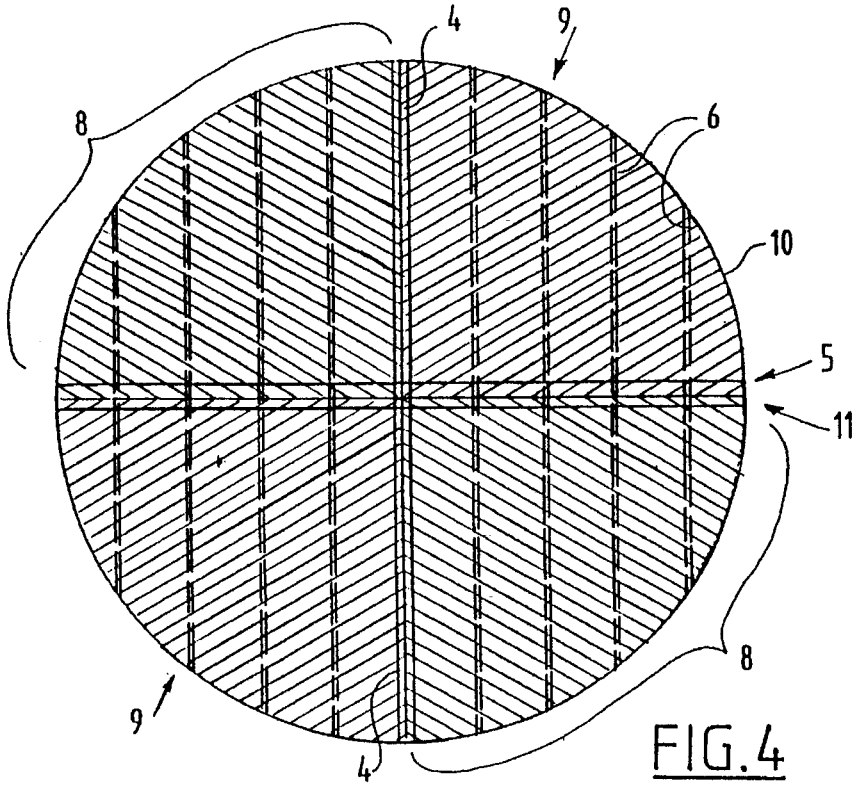
FIG. 4 is a view corresponding with FIG. 3 but wherein the construction is divided into four segments.

Shown by way of comparison in FIG. 4 is a top view of a similar construction which is however divided into four sectors instead of six. The secondary sub-girders 7 are herein also omitted. The configuration of the primary main girders 4, the secondary main girders 5 and the primary sub-girders 6 is also visible here.

The folds 10 of strips 9 do not extend mutually parallel at the position of the secondary main girders 5. In the embodiment it is therefore also necessary that extra sealing strips 11 are arranged at these positions. At the position of the primary main girders 5 it is then likewise necessary for such sealing strips 11 to be arranged. With respect to the angle of folding of the strips 9, which amounts in the present embodiment to roughly 60°, the sealing strips 11 will not be the same at the location of the primary, respectively secondary main girders.

Only if the folding angle of the folds in the sealing strips 9 were to amount to 45° would it be possible to make use of the same sealing strips 11.

Shown in FIG. 5 is a combination of two sealing strips 9 meeting one another at the position of the primary sub-girder 5. It is shown clearly here that the folds 10 of both strips 9 extend mutually parallel so that the strips are mutually connecting.

Shown in FIG. 6 is a perspective view of a sealing strip 11. This latter is provided with a central fold 12 parallel to the lengthwise direction of the strip. Further arranged are zigzag folds 13 extending in a herringbone pattern. The angle at which these folds extend relative to the main fold 12 is of course related to the angle at which the folds 10 in the strips 9 extend in order to ensure a good sealing.

FIG. 7 is a lengthwise sectional view of the strip 9 showing the zigzag manner of folding.

FIG. 8 and 9 show alternative forms of folding the strips 9. When these fold profiles are used it will be necessary to adapt the folding of the sealing strips 11.

Shown is FIG. 10 is how a double curved surface, in the present case a hyperbolic paraboloid, is covered with zigzag folded strips.

The starting point in the foregoing is sealing material in the form of strips of steel. Steel is of course an attractive material in respect of the elastic properties, strength and relatively low cost price. It is of course possible to make use of other materials such as aluminum, other metals or plastics.

The construction 15 comprises four triangular walls 16, 17, 18 and 19. Arranged between two opposite walls 16, 18 is a series of supporting girders 20 extending substantially parallel to each other. Arranged between each pair of girders 20 is a strip 9, only one of which is shown in the drawing. In the embodiment shown the folds are arranged perpendicularly of the lengthwise direction. This is not essential however; they can equally be arranged obliquely. What is essential is the fact that the folds of adjacent elements connect mutually so that a good water drainage is obtained.

Instead of the construction shown it is possible to manufacture differently formed constructions according to the invention. It is thus possible for instance to cover a cylinder-shaped surface in the manner of a spiral with strips according to the invention. It is also possible to construct paraboloids of revolution according to the invention.

We claim:

1. A construction formed in accordance with a double curved substantially spherical skin-shaped surface having a center and a peripheral edge, the construction comprising:

a number of regularly distributed primary main elements extending radially along the construction from the center to the edge;

a number of secondary main elements corresponding with the number of primary main elements and extending radially intermediate the primary main elements;

a plurality of primary sub-elements, each said primary sub-element extending parallel to a closest of one of said primary main elements from the secondary main elements towards the edge, said primary main elements and said primary sub-elements each being spaced apart a distance such that the distances between the primary main elements and adjacent primary sub-elements and the distance between each pair of adjacent primary sub-elements are substantially equal;

characterized by:

strips of substantially flat, slightly flexible material extending to the edge from each secondary main element between each pair of adjacent primary sub-elements and between each primary main element and the adjacent primary sub-elements, the strips being supported by the primary sub-elements and the primary main elements, and each strip having a width at least as large as the distances between adjacent primary sub-elements.

2. A construction as claimed in claim 1, characterized by secondary sub-elements extending between the primary main elements and the edge.

3. A construction as claimed in claim 2, characterized in that each secondary sub-element is parallel to a closest of the secondary main elements, and that said secondary main elements and said secondary sub-elements each being spaced apart a distance such that the distances between the secondary main elements and adjacent secondary sub-elements and the distance between each pair of adjacent secondary sub-elements are substantially equal.

4. A construction as claimed in claim 3, characterized in that the primary and secondary elements intersect one another to form spaced apart joints, and that tertiary elements are arranged to extend between the joints of the primary elements and the secondary elements and extend substantially concentrically in relation to the center.

5. A construction as claimed in claim 4, characterized in that the primary, secondary and tertiary elements are embodied in the form of a continuous skin.

6. A construction as claimed in any of the claims 1–4, characterized in that the elements are girders.

7. A construction as claimed in any of the claims 1–4, characterized in that the elements are walls.

8. A construction as claimed in any of the claims 1–4, characterized in that the elements are rods mutually connected in said joints.

9. A construction as claimed in claim 1, characterized in that the strips are formed by strips of material folded according to a regular pattern, and that the strips are folded such that the fold direction is substantially parallel to the closest secondary main element.

10. A construction as claimed in claim 9, characterized in that each strip of material is folded in a zigzag.

11. A construction as claimed in claim 9, characterized in that each strip of material is folded in a sine shape.

12. A construction as claimed in claim 9, characterized in that each strip of material is folded in a trapezium shape.

13. A construction as claimed in claim 1, characterized in that sealing strips are provided along adjacent strips of material bordering each primary main element.

14. A construction as claimed in claim 13, characterized in that the sealing strips are folded in a lengthwise direction and that the thus formed halves are each provided with zigzag folds formed in a herringbone pattern.

* * * * *